United States Patent [19]

Cooley

[11] Patent Number: 4,709,527

[45] Date of Patent: Dec. 1, 1987

[54] SHEETROCK HANGING TOOL

[76] Inventor: John Cooley, 208 Haystack Rd., Zephyrhills, Fla. 34249

[21] Appl. No.: 921,615

[22] Filed: Oct. 21, 1986

[51] Int. Cl.[4] ..... E04D 15/00

[52] U.S. Cl. ..... 52/749; 52/127.2; 52/489; 52/712; 52/DIG. 1

[58] Field of Search ..... 52/696–699, 52/702, 712–715, 749, 127.2, DIG. 1, 487, 489, 357, 359; 249/211, 213, 219 R, 219 W

[56] References Cited

U.S. PATENT DOCUMENTS

| | | | |
|---|---|---|---|
| 2,689,101 | 9/1954 | Dygert | 249/219 W |
| 2,985,417 | 5/1961 | Thompson | 52/712 |
| 3,352,429 | 11/1967 | Magnuson | 52/712 |
| 3,500,604 | 3/1970 | Vandall | 52/489 |
| 3,578,282 | 5/1971 | Olsen | 248/214 |
| 4,112,636 | 9/1978 | Hays | 52/713 X |
| 4,226,058 | 10/1980 | Riley | 52/27 |
| 4,330,971 | 5/1982 | Auberger | 52/712 X |
| 4,449,338 | 5/1984 | Reicherts | 52/749 X |
| 4,571,902 | 2/1986 | Liebetrau | 52/DIG. 1 |

*Primary Examiner*—Carl D. Friedman

[57] ABSTRACT

A hanger made from a rigid sheet, having two legs, one offset at a right angle to the other, the two legs connected by a third member, the opening thus formed being of a size to contain a beam and a sheet of sheetrock. A multiplicity of notches on the edges of the third member allows the hanger to be attached to a beam by means of nails in a removable manner.

2 Claims, 4 Drawing Figures

SHEETROCK HANGING TOOL

FIELD OF INVENTION

This invention relates to small hand tools, and particularly to tools utilized in the hanging of sheetrock. Specifically, this invention addresses itself to a device to retain sheetrock ceiling sheets in place while attaching them.

PRIOR ART

The product generally called 'sheetrock' or 'drywall' is a sandwich composed of plaster between two sheets of paper. It is relatively rigid, may be made in large sheets very economically, and hence is much favored for the indoor finishing of buildings. Unfortunately for those persons who install sheetrock, the material is also very heavy, a standard 4'×8'×5/8" sheet weighing about seventy five pounds. This has produced a long-recognized need for a device to hold sheetrock in position during the application procedure (it being usually applied by nailing). There are many such devices on the market, but they are uniformly characterized by being bulky, awkward and expensive. Since the application of sheetrock to walls is of less difficulty, the workman usually being able to rely on gravity to assist him, most devices have addressed themselves to the problem of supporting the sheet near the ceiling. Uniformly, devices to accomplish this task are some variety of floor stand or jack, upon which the sheetrock may be placed by two persons, then raised to the ceiling where it can then be positioned and nailed into place. So cumbersome are these devices, and so slow are they to operate, that sheetrock construction persons (who are often paid by piecework) tend to be individuals of exceptional strength, height and endurance, since the best are often able to singlehandedly lift a sheet overhead, hold it against the ceiling, and, with the aid of a magnetic hammer, strike in the four nails required to hold the sheet in place during the remainder of the installation.

OBJECTS OF THE INVENTION

It is the object of this invention to provide a small, simply operated and inexpensive device to hold sheetrock in proximity to a ceiling, to facilitate the installation of the sheet. It is a further purpose of this invention to provide such a device that will function in the majority of applications without having to rely on floor based jacks, holders, struts, etc.

DRAWINGS

DESCRIPTION OF THE INVENTION

Figure 1:
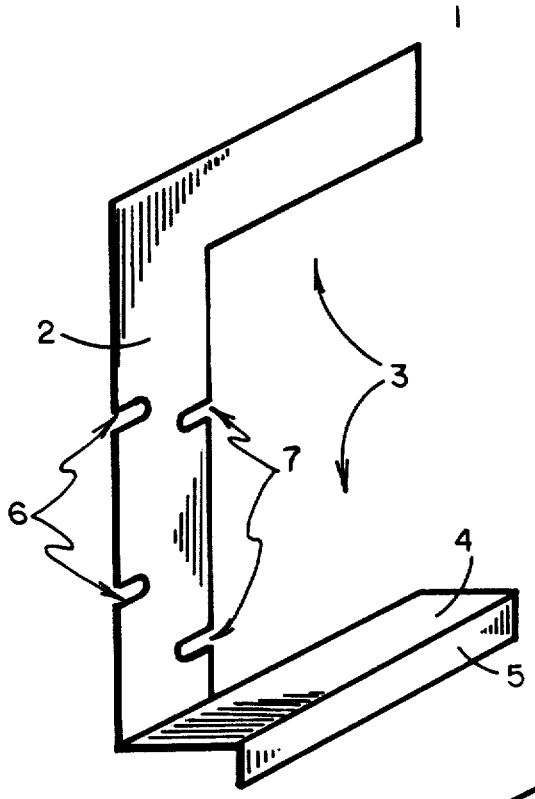
FIG. 1 shows an overall view of the invention.

Refer now to the drawings, wherein FIG. 1 shows an overall view of one embodiment of the invention. It may be seen that the device is made from a thin foldable and rigid sheet material such as steel or aluminum. Generally "C" shaped in outline, it has an upper leg (1) a vertical leg (2) and a lower leg (4). It may be noted that the three legs define an opening (3). Upper leg (1) is coplaner with vertical leg (2) while lower leg (4) is bent at right angles to upper leg (2) and bears a folded strenghening lip, (5). Vertical leg (2) bears two or more notches (6) in the edge farthest away from opening (3) and two or more notches (7) on the edge facing the opening.

Figure 2:
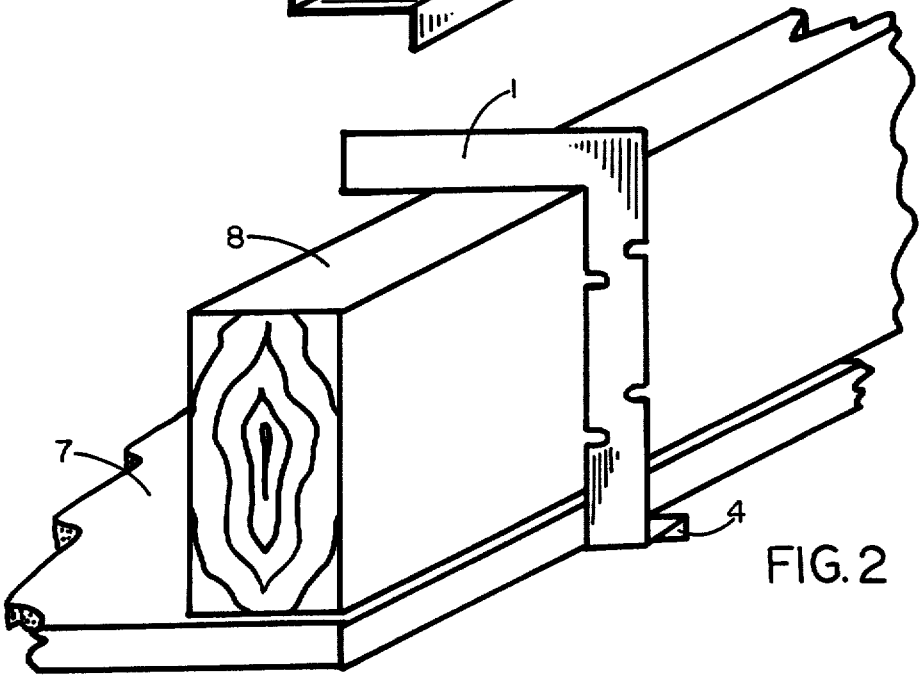
FIG. 2 shows a view of the invention in one of its operating modes.

FIG. 2 shows the device in one of its possible 3 modes of use, in which it is placed over a beam (8) and supports a sheet of sheetrock (7) in near proximity to the beam to which it is to be fastened.

Figure 3:
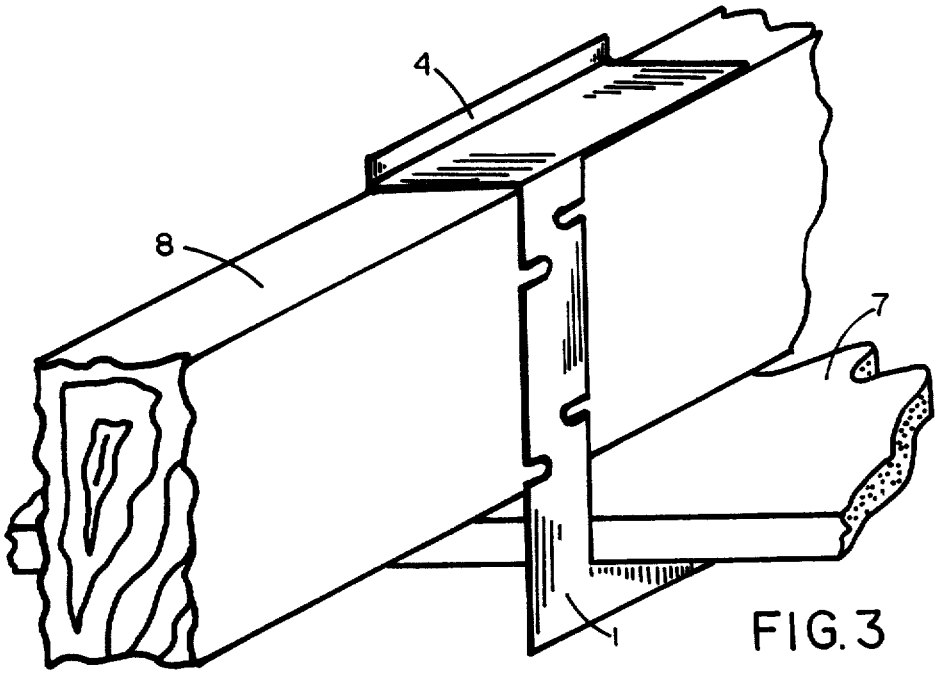
FIG. 3 shows a view of the invention in a second operating mode.

FIG. 3 shows the invention in use in the second of its possible methods of use, in which the lower leg (4) is placed above the beam (8) and the upper leg (1) supports the sheetrock (7) in near proximity to the beam.

Figure 4:
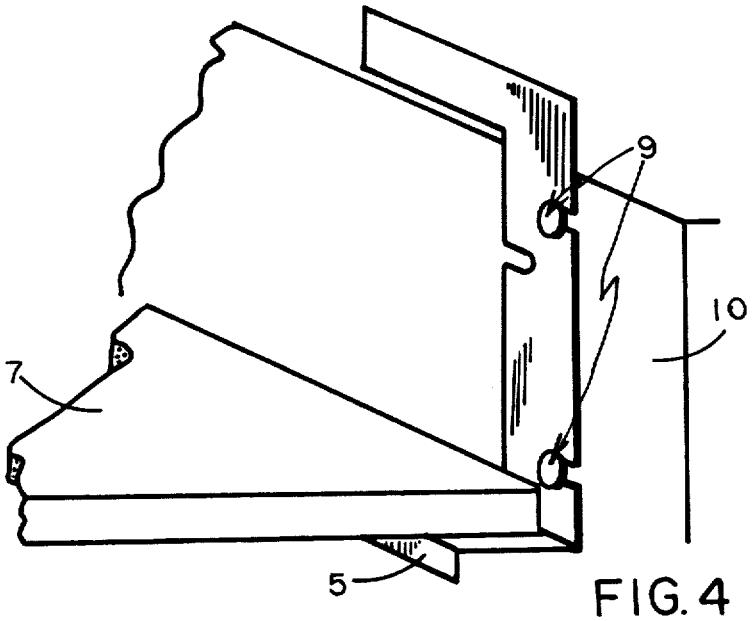
FIG. 4 shows the invention in its third operating mode.

FIG. 4 shows the invention being used in the third possible method of use, in which the vertical leg is held to a wall by a pair of nails (9) while the sheetrock (7) is supported by the lower leg (4) partially hidden here, beneath the sheet.

In practice the sheetrock hanger is made from a flat sheet of metal, preferably steel or aluminum. If steel is used, good practice would dictate the use of galvanized or painted material to prevent rust, although such is not necessary. This sheet has an opening (3) cut from the sheet, of such dimension that the height of a standard beam (5¾ inches) added to the thickness of a piece of sheetrock (¾ inch) plus a ¼ inch clearance will fit exactly between the upper leg (1) and the lower leg (4). The lower leg (4) is braked at a 90 degree angle to the vertical leg (2). The lower leg (4) also bears a strengthening tab (5) bent down from the lower leg (4). This bend may be of any angle, as this edge serves to strengthen and stiffen the flat surface of (4) but, as will be seen, should be of sufficient size, and bent at a sufficiently acute angle, that is may be easily struck on the end by a hammer. The width of flat surface (4) need be no more than the width of the base (usually 1¾ inches). The vertical leg (2) bears two or more notches adapted to take a standard sheetrock nail, (usually about 5/32 inch in diameter) with a nominal amount of clearance on each side. The intent here is to provide a means to nail the Hanger to the side of a beam, and yet allow sufficient clearance so that it may be driven off with a few light hammer blows. To this end, bent tab (5), should be of sufficient width as to afford a comfortable striking surface on one end. In practice, ½ inch has proven to be very satisfactory.

OPERATION

In operation, one or two persons lift the sheetrock up to the ceiling in approximately the desired position, and a sheetrock hanging tool is used in one of the three support modes on each side of the sheet. The operating mode shown in FIG. 2 is utilized when an edge terminates at or near a beam running parallel to that edge: that is to say that the upper leg (1) is placed over the beam while lower leg (4) supports the sheet on its flat surface. When a beam crosses an edge at an angle to the line of the edge, the method of FIG. 3 is used to support the sheetrock. In this mode, the lower leg (4) is used to hook over the beam, while the edge of the upper leg (1) is used to support the sheet. In cases where the sheetrock must proximate a vertical wall, either the inside or outside set of notches (6), are used to allow temporary attachment of the tool to the horizontal beam at the top of the wall, thus supporting that edge of the sheetrock. The tool may be easily removed by striking the downturned section (5) with a hammer, leaving the nails behind. The very thin opening left behind due to the thickness of the hanger is well within the tolerances acceptable in sheetrock work.

Those skilled in the art of applying sheetrock will understand that the examples of structure given for the sheetrock hanging tool are specific examples, and may be departed from substantially without violating the concept of this invention. For example, various methods of manufacture such as die casting could be used for making the tool, and modifications in relative dimensions may be made to accomodate different sizes of beams without departing from the intent of this invention.

What is claimed is:

1. A sheetrock hanging tool comprising a rigid steel having a first, second and third legs, said first and second legs being contiguous, flat and coplaner with each other, said third leg bent substantially at right angles to the plane of said first and second legs, said first, second and third legs defining a generally rectangular opening, saaid third leg bearing a bent lip, said second leg bearing a multiplicity of notches, said notches of a size and shape to accept one or more nails whereby said tool may be temporarily retained against a flat surface.

2. A sheetrock hanging tool of claim 1, said lip set at substantially right angles to the plane of said third leg, said lip large enough, and suitably disposed as to be capable of being struck by a hammer blow, said notches so oriented that such a hammer blow will remove said tool from its state of retention.

* * * * *

UNITED STATES PATENT AND TRADEMARK OFFICE

CERTIFICATE OF CORRECTION

PATENT NO. : 4,709,527

DATED : 12/01/87

INVENTOR(S) : John Cooley

It is certified that error appears in the above-identified patent and that said Letters Patent is hereby corrected as shown below:

Column 3, line 15, Claim 1, "steel" should read --sheet--.

Signed and Sealed this

Twenty-eighth Day of June, 1988

*Attest:*

DONALD J. QUIGG

*Attesting Officer*

*Commissioner of Patents and Trademarks*